US012680317B1

(12) United States Patent
Owen

(10) Patent No.: US 12,680,317 B1
(45) Date of Patent: Jul. 14, 2026

(54) MECHANICAL CHUTE FOR KITCHEN FOOD WASTE REMOVAL AND CONTAINMENT

(71) Applicant: David Russell Owen, Bellingham, WA (US)

(72) Inventor: David Russell Owen, Bellingham, WA (US)

( * ) Notice: Subject to any disclaimer, the term of this patent is extended or adjusted under 35 U.S.C. 154(b) by 94 days.

(21) Appl. No.: 18/938,889

(22) Filed: Nov. 6, 2024

Related U.S. Application Data

(60) Provisional application No. 63/596,684, filed on Nov. 7, 2023.

(51) Int. Cl.
*B65G 11/12* (2006.01)
*E04F 17/12* (2006.01)

(52) U.S. Cl.
CPC ..... *E04F 17/12* (2013.01)

(58) Field of Classification Search
CPC ..... E04F 17/12; B65G 11/12; B65G 11/16
USPC ..... 193/33, 34
See application file for complete search history.

(56) References Cited

U.S. PATENT DOCUMENTS 646,930 A * 4/1900 Cocherell
886,112 A * 4/1908 Clark
2,062,793 A * 12/1936 Nicol ..... F23G 5/444 220/477
3,095,073 A * 6/1963 Larson ..... B65G 11/026 193/17
3,702,650 A * 11/1972 Boyd ..... E04F 17/12 193/34
4,041,857 A * 8/1977 Weeks ..... B30B 9/3032 100/255
4,278,163 A * 7/1981 Tomich ..... E06B 5/02 193/34
4,310,089 A * 1/1982 Bondeson ..... B65F 1/0093 198/530
5,090,546 A * 2/1992 McDermott ..... B65F 1/0093 49/67
7,350,636 B2 * 4/2008 Smith ..... E04F 17/12 193/34
10,398,246 B2 * 9/2019 Crooks ..... A47G 29/12

FOREIGN PATENT DOCUMENTS

GB 2035273 * 6/1980
GB 2080400 * 2/1982

OTHER PUBLICATIONS

US 2006/0113159 A1, Nyquist, Jun. 1, 2006.*

* cited by examiner

*Primary Examiner* — Douglas A Hess
(74) *Attorney, Agent, or Firm* — Plager Schack LLP

(57) ABSTRACT

A mechanical chute apparatus installable in a wall opening for waste removal includes: a housing having a curved pivot and a ventilation opening; a drawer installed in the housing; a chute pan pivotally mounted to the drawer; and drawer hardware for mounting the drawer in the housing and for opening and closing the drawer. The chute pan has a front end and a rear end, and has a first position with the rear end horizontal to the front end, and a second position with the rear end pivoted below the front end. When the drawer is open, the chute pan is in the first position to receive at least one waste item. When the drawer is closed, the chute pan is in the second position so the at least one waste item may fall out of the chute pan for disposal thereof.

12 Claims, 3 Drawing Sheets

MECHANICAL CHUTE FOR KITCHEN FOOD WASTE REMOVAL AND CONTAINMENT

RELATED APPLICATION

This application claims priority to provisional patent application U.S. Ser. No. 63/596,684 filed on Nov. 7, 2023, the entire contents of which is herein incorporated by reference.

BACKGROUND

The embodiments herein relate generally to garbage disposal, and more particularly to a mechanical chute apparatus for kitchen food waste removal and containment.

Kitchen food scraps and food waste generated from meals and/or food preparation stored in a container in the kitchen for later removal for garbage, recycling or composting can be unhygienic, unsightly, and malodorous, and may attract insects such as flies and other pests. Also, food waste stored in a container must be manually carried out of the kitchen.

Placing food scraps and waste in the garbage or in a sink garbage disposal is ecologically unsustainable. Food waste disposed in regular garbage ends up in a landfill, contributing to its greenhouse gas (GHG) footprint. Food waste disposed of in a sink garbage disposal will enter a sewer system, requiring additional processing at a water treatment plant, which still produces solid waste that will end up in the landfill.

Therefore, what is needed is a mechanical chute apparatus for kitchen food waste removal and containment that easily and conveniently removes food waste out of the kitchen for outdoor containment and composting.

SUMMARY

Some embodiments of the present invention include a mechanical chute apparatus for waste removal and containment. The mechanical chute apparatus is constructed and arranged for installation in a wall of a building structure and includes a chute housing configured for installation in a chute apparatus opening or wall opening in the wall of the building structure. The chute housing includes a housing curved pivot and a chute ventilation opening. A chute drawer attached to a drawer exterior face is removably installed in the chute housing. A chute pan is pivotally mounted to the chute drawer, the chute pan having a front chute pan end and a rear chute pan end. The chute pan has a first horizontal position, wherein the rear chute pan end is horizontal to the front chute pan end, and a second pivoted position, wherein the rear chute pan is positioned at an angle to and below the front chute pan end. The mechanical chute apparatus may include drawer hardware configured to mount the chute drawer in the chute housing and to open and close the chute drawer. The chute drawer may be opened so the chute pan is in its first horizontal position to place at least one waste item in the chute pan and may be closed, placing the chute pan in its second pivoted position, to permit the at least one waste item to fall out of the chute pan for disposal thereof.

The mechanical chute apparatus distinguishes over what currently exists, providing an unprecedented through-wall apparatus consumers may use in a one-step process to remove food waste easily and conveniently from the kitchen and contain it outside, thereby eliminating odors and flies indoors. The mechanical chute apparatus also eliminates extra containers that may take up space on kitchen countertops or beneath the sink. More importantly, it helps consumers keep waste out of landfills by promoting food waste recycling and composting as it creates an easy, hygienic, and ecological way to keep food waste contained and separate from regular garbage in a receptacle outside the kitchen until being transferred for composting or containment outside for curbside recycling pick-up.

BRIEF DESCRIPTION OF THE FIGURES

The detailed description of some embodiments of the invention is provided below with reference to the accompanying figures, wherein like numerals represent corresponding parts of the figures.

DETAILED DESCRIPTION OF CERTAIN EMBODIMENTS

Figure 1:
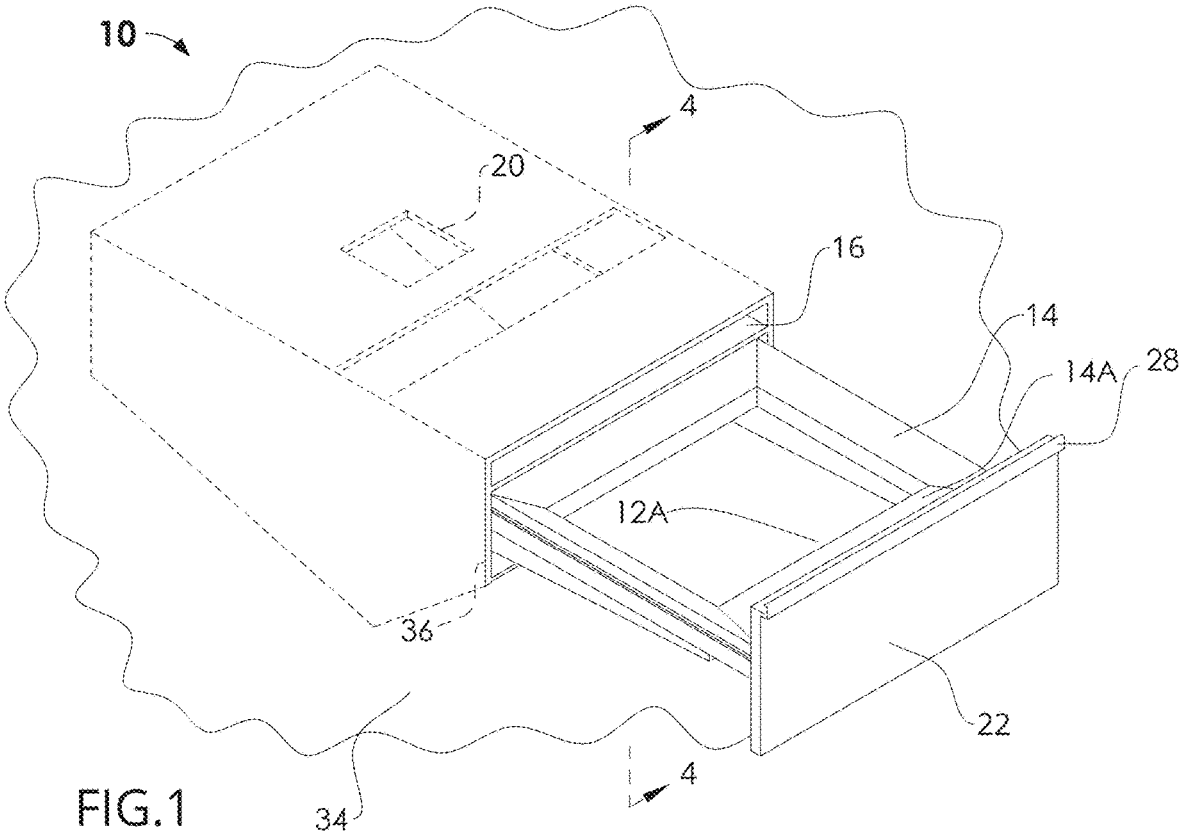
FIG. 1 is a top front left perspective view of the invention.
Figure 2:
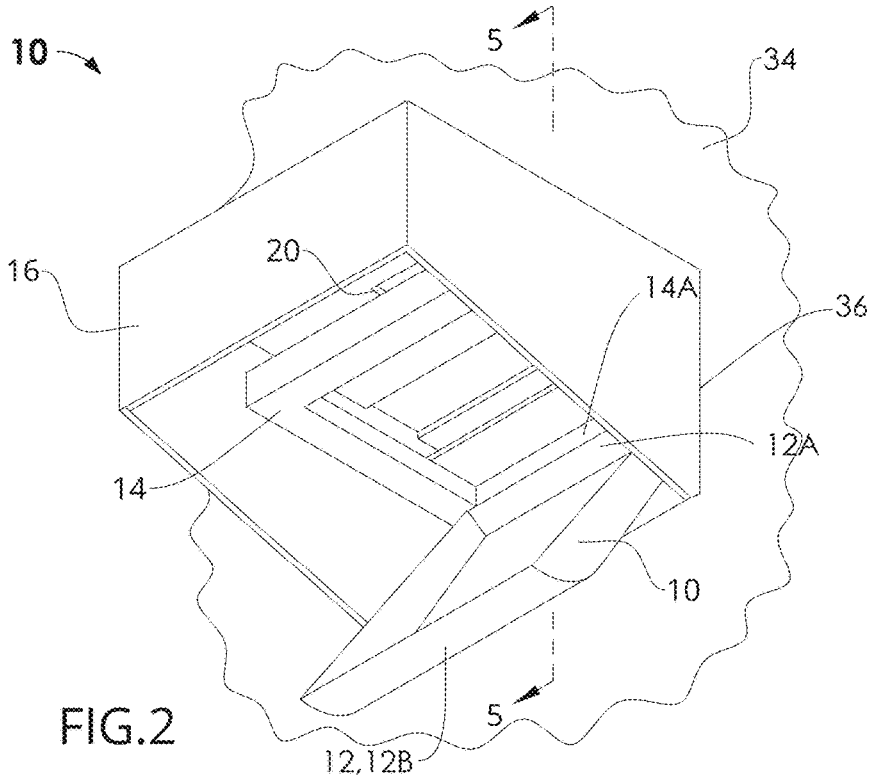
FIG. 2 is a bottom rear left perspective view of the invention.
Figure 3:
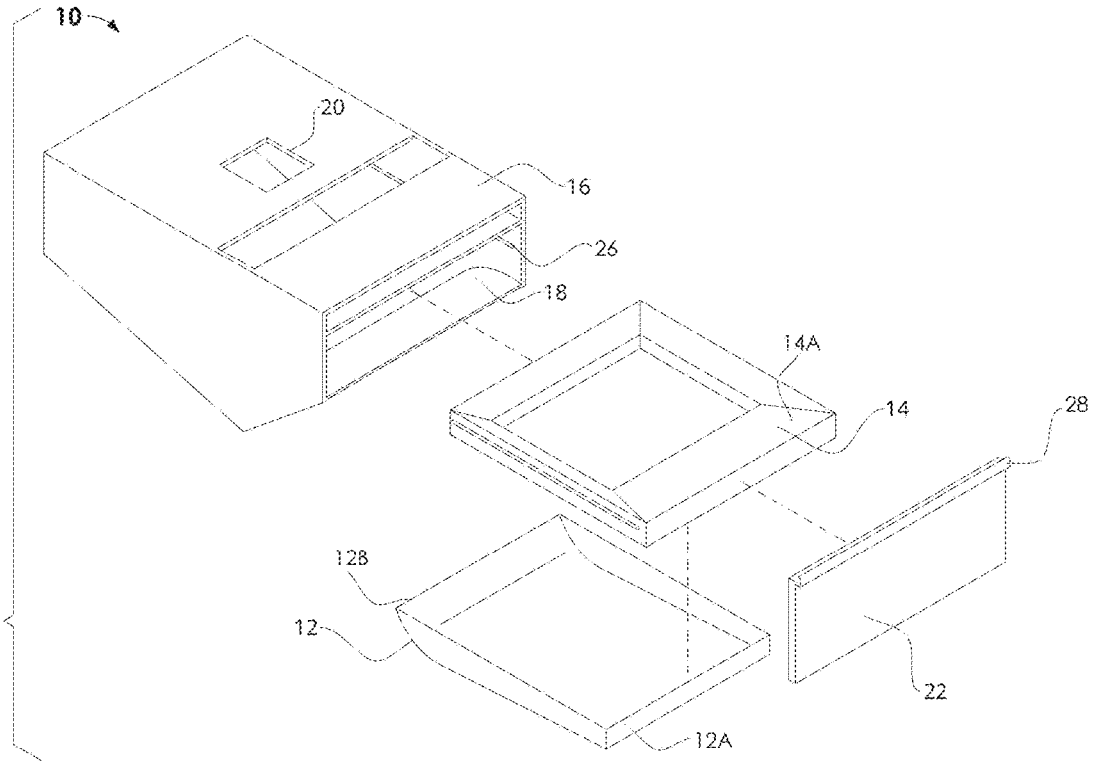
FIG. 3 is an exploded view of the invention.

In the following detailed description of the invention, numerous details, examples, and embodiments of the invention are described. However, it will be clear and apparent to one skilled in the art that the invention is not limited to the embodiments set forth and that the invention can be adapted for any of several applications.

The apparatus of the present invention may be used as a mechanical chute apparatus for kitchen food waste removal and containment. In embodiments, the mechanical chute apparatus may be used to remove any suitably sized object from one room and deposit it into another room or to the exterior of a building. In some embodiments, the mechanical chute apparatus may be used as a general garbage disposal chute, a general recycling disposal chute, a bio-hazard waste disposal chute, or a sharp objects disposal chute.

The mechanical chute apparatus may be installed in a wall having a wall opening sized to receive the mechanical chute apparatus. The mechanical chute apparatus may comprise a chute housing, a housing curved pivot, a chute ventilation opening provided on the chute housing, a chute drawer removably installed in the chute housing, a drawer exterior face, and a chute pan pivotally mounted to the chute drawer. This list of possible constituent elements is intended to be exemplary only, and it is not intended that this list be used to limit the apparatus of the present application to just these elements. Persons having ordinary skill in the art relevant to the present invention may understand there to be equivalent elements that may be substituted within the present disclosure without changing the essential function or operation of the apparatus.

By way of example, and referring to FIGS. 1-5, some embodiments of the present invention include a mechanical chute apparatus 10 (hereinafter apparatus 10) constructed and arranged for installation in a wall 34 of a building structure. The apparatus 10 comprises a chute housing 16 configured for installation in a chute apparatus opening (also referred to as through-wall opening) 36 in the wall 34 of the building structure. The chute housing 16 has a housing top, a housing bottom, a first housing side, a second housing side and a housing interior surface. The chute housing 16 includes at least one chute ventilation opening 20 extending therethrough, and a housing curved pivot 18 located at the housing bottom on the housing interior surface. A chute drawer 14 is removably mounted or installed in the chute housing 16. The chute drawer 14 has a first drawer side, a second drawer side, a drawer rear, and a drawer front 14A, which together define a central drawer opening. A drawer exterior face (or drawer trim) 22 may be attached to the drawer front 14A. A chute pan 12 is pivotally mounted to the chute drawer 14 at a rear, lower portion of the drawer front 14A, the chute pan 12 having a front chute pan end 12A, a rear chute pan end 12B and a chute pan opening. The chute pan 12 has a first horizontal position, best seen at FIG. 4, wherein the rear chute pan end 12B is horizontal to the front chute pan end 12A, and wherein at least a portion of the chute pan opening rests adjacent to a lower surface of the chute drawer 14, and a second pivoted position, best seen at FIG. 5, wherein the rear chute pan end 12B is positioned at an angle to and below the drawer front 14A. The housing curved pivot 18 is configured to support the chute pan 12 as a bottom surface of the chute pan travels along the housing curved pivot 18 and pivots downwardly when the chute drawer 14 is closed. The apparatus 10 may further comprise any suitable fastening devices and hardware, such as an adhesive or drawer hardware for attaching the drawer exterior face 22 to the drawer front 14A of the chute drawer 14, and drawer hardware to mount the chute drawer 14 in the chute housing 16 and to open and close the chute drawer 14. The drawer hardware may comprise a pivotal mounting means (or chute hinge) 24 for mounting the chute pan 12 to the chute drawer 14, a pair of linear drawer tracks or drawer slides 26 configured to support the chute drawer 14 and permit the chute drawer 14 to be opened and closed, a drawer pull or handle 28, and any other conventional drawer hardware. The chute drawer 14 may be constructed in a manner similar to a picture frame. The chute drawer 14 remains in a flat horizontal position for movement forward and rearward in the chute housing 16 like a conventional drawer. The chute pan 12 is pivotally mounted to the chute drawer 14 by the chute hinge 24. In use, the chute drawer 14 may be opened so the chute pan 12 is in its first horizontal position with the central drawer opening of the chute drawer 14 coextensive with at least a portion of the chute pan opening of the chute pan 12 to permit waste material deposited in the chute drawer 14 to fall into the chute pan 12. After at least one waste item is placed in the chute pan 12, the chute drawer 14 may be closed so the chute pan 12 is placed in its second pivoted position to permit the at least one waste item to fall out of the chute pan 12 for disposal thereof. At least a portion of the rear chute pan end 12B may be curved to allow the at least one waste item to more easily slide out of the chute pan 12.

The various elements of the apparatus 10 of the present invention may be related in the following exemplary fashion. It is not intended to limit the scope or nature of the relationships between the various elements and the following examples are presented as illustrative examples only. Assembly and installation of the apparatus 10 may occur in any order. The through-wall opening 36 sized to accommodate the chute housing 16 is provided or created through a wall 34. In some embodiments, the through-wall opening 36 is made with a lower border positioned at a height approximately waist height level for most operators. The chute housing 16 is placed into the through-wall opening 36 so the front of the chute housing 16 is flush with the finished plane of the wall 34 on the side of an operator. The chute housing 16 may be secured to the structure of the wall 34 with any suitable fastening means. The housing curved pivot 18 and the drawer slides 26 may be installed into the chute housing 16 in any order, and may be installed before or after the chute housing 16 is installed in the through-wall opening 36. In some embodiments, the housing curved pivot 18 may be integrally molded with or permanently affixed to the chute housing 16. The drawer slides 26 may be placed at opposite sides of an interior surface of the chute housing 16. The drawer exterior face 22 may be attached to the chute drawer 14. The chute drawer 14 and the chute pan 12 may be connected by the chute hinge 24. The assembled drawer exterior face 22, chute drawer 14, chute hinge 24, and chute pan 12 may be inserted with the rear chute pan end 12B of the chute pan 12 first, through the front end of the chute housing 16 and placed on the drawer slides 26, so the apparatus 10 is ready for use by the operator.

To use the apparatus 10, the operator stands in front of the apparatus 10 and pulls the chute drawer 14 out, so it extends from the wall 34 in a horizontal position and stops at the full extension of the drawer slides 26. The chute pan 12 is thus in the first horizontal position. Waste material may then be deposited into the chute pan 12. When the chute drawer 14 is pushed closed, the bottom of the chute pan 12 travels along the housing curved pivot 18 which guides the rear chute pan end 12B from its first horizontal position downwards into its second pivoted position, angled downwardly from, or vertically with respect to, the chute drawer 14. The waste material then drops from the apparatus on an exterior side of the wall 34. The waste material may be collected on the exterior side of the wall 34 in a container separate from regular garbage, until transfer for composting or pickup for disposal or recycling.

The apparatus 10 and its components may be made of any suitable materials, and fabricated by any suitable fabrication method. The apparatus 10 and its components may be made of weather- and UV-resistant materials capable of withstanding exposure to moisture and exterior environments over long periods of time, such as, for example without limitation, weather- and UV-resistant plastics and metals. In some embodiments, the chute housing 16 and the chute drawer 14 may be made of plastic paneling, such as marine grade King StarBoard® ST HDPE panels. The chute housing 16, the chute drawer 14 and the chute pan 12 may be made of panels of a flat rigid panel material, such as, for example without limitation, plastic, fiber-reinforced plastic (FRP) or plywood. In some embodiments, the chute pan may have a first chute pan side panel, a second chute pan side panel, a chute pan rear panel, and a chute pan rear nose end panel made of a flat rigid material such as plastic, FRP or plywood, and a chute pan bottom made of 20-26 ga. sheet metal. In some embodiments, the chute pan rear panel and/or the chute rear nose end panel may be curved. In some embodiments, the housing curved pivot 18 may be made of a flat thin rigid material that is curved and sized to fit and/or be attached to a bottom front area of the chute housing 16. The housing curved pivot 18 may be made of a suitable strong sheet metal or plastic material capable of providing a pivot for the chute pan 12 to rest on and also to travel from the first horizontal position to the second pivoted position as the chute drawer 14 is pushed back into the wall 34 and then from the second pivoted position to the first horizontal position as the chute drawer 14 is opened and pulled towards the operator of the apparatus 10. All fasteners and hardware may be made of any suitable weather-resistant materials. The chute hinge 24 may be any suitable hinge. In some embodiments, the chute hinge 24 may be made from flat rigid metal material sized to connect the chute drawer 14 to the chute pan 12, providing the only fastened connection point therebetween.

To make the chute housing 16, a panel material may be cut in specific sizes and shapes to provide a plurality of housing panels comprising a housing first side panel, a housing second side panel, a housing rear panel, a housing bottom panel, and a housing top panel. The chute ventilation opening 20 may be cut in a housing panel, such as in the housing top panel. A side groove may be routed out on each of the housing first and second side panels, the groove extending the full length the panel for the drawer slides 26 to sit therein. An arcuate groove may be routed on each of the first and second side panels at the bottom/front thereof to accommodate the housing curved pivot 18 in embodiments where the housing curved pivot 18 comprises a curved pivot sheet metal material to be installed therein. The side grooves and the arcuate grooves may be "mirror image" opposites of each other on each of the first and second side panels. Before installing the housing bottom panel, the housing curved pivot 18 may be slid into place and locked in place by installing the housing bottom panel. The drawer slides are installed in the side grooves of first and second side panels. The housing panels may be connected with suitable fasteners or adhesive to complete construction the chute housing 16.

To make the chute drawer 14, a panel material may be cut in specific sizes and shapes to make each of the four rail portions of a frame of the chute drawer 14, which may be respectively attached to one another using suitable fasteners or adhesive.

To make the chute pan 12, a panel material may be cut in specific sizes and shapes to make a first chute pan side panel, a second chute pan side panel, a chute pan rear panel, and a chute pan rear nose end panel of the chute pan 12. A side arcuate groove is routed near the bottom of each of the first and second chute pan side panels, and a rear panel groove is routed near the bottom of the chute pan rear panel. The grooves may be made using a pre-designed template. The first chute pan side panel is connected to a first end of the chute pan rear panel, and the second chute pan side panel is connected to a second end of the chute pan rear panel, ensuring the grooves are aligned. A chute pan bottom is slid into the grooves of each of the first and second side panels until the chute pan bottom also fits into the rear panel groove. The chute pan rear nose end panel is attached to the chute pan bottom, and the first and second chute pan side panels. Each portion of the chute pan 12 may be connected with suitable fasteners or adhesive to complete construction of the chute pan 12.

Figure 4:
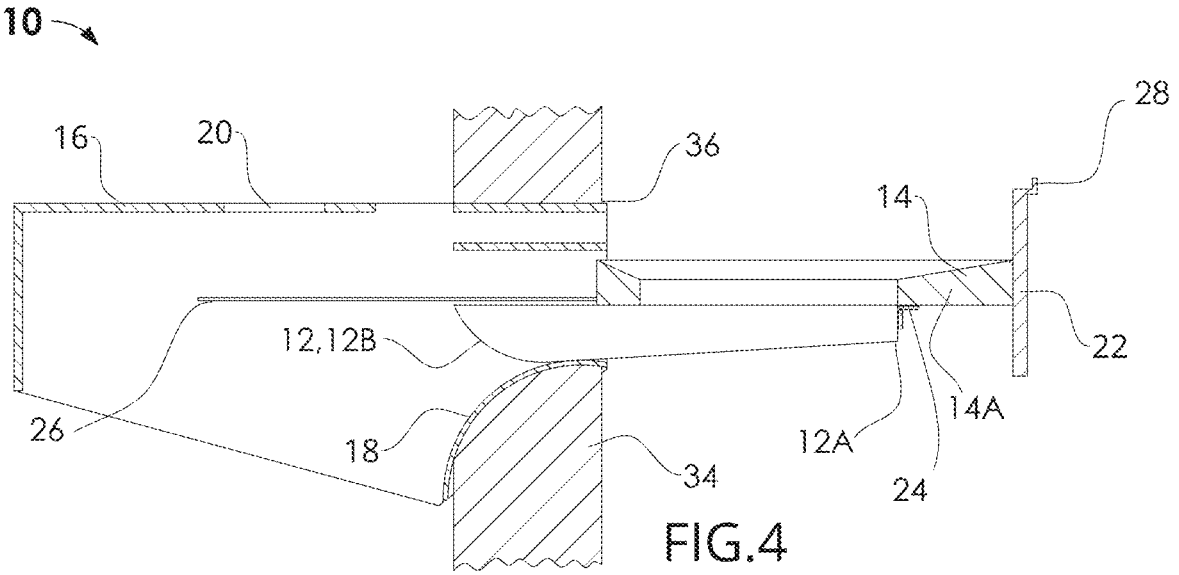
FIG. 4 is a section view of the invention taken along line 4-4 in FIG. 1.
Figure 5:
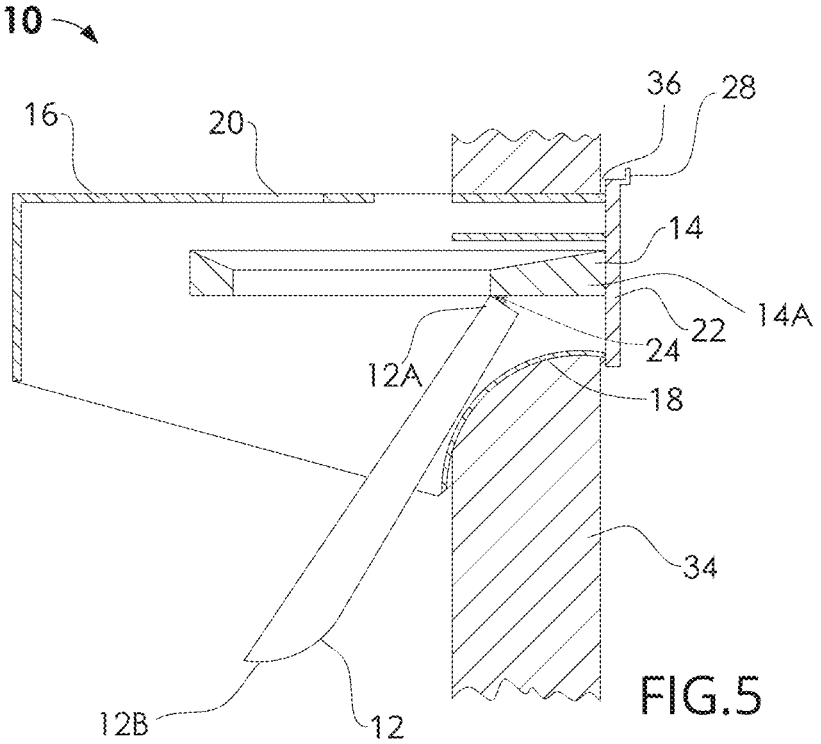
FIG. 5 is a section view of the invention taken along line 5-5 in FIG. 2.

The chute pan 12 and the chute drawer 14 may be connected by the chute hinge 24, best seen at FIGS. 4-5. For example, a first side of the chute hinge 24 may be installed on the chute pan, 12 and a second side of the chute hinge 24 may be installed on the chute drawer 14. In some embodiments, the first side of the chute hinge 24 may be mounted to an outer surface of the chute pan front 12A, and the second side of the chute hinge 24 may be installed on an interior underside edge portion of a front rail of the chute drawer 14 at the drawer front 14A. After the chute pan 12 and the chute drawer 14 are connected, the chute drawer 14 may be installed rear nose end first into the chute housing 14 and onto the drawer slides 26.

The apparatus 10 and its components may have any size and dimensions. The apparatus 10 may have a width of between about 10 to 36 inches, depending on the desired use of the apparatus 10. The apparatus 10 may be constructed and arranged to fit in a wall opening of a building wall 34 between a traditional stud layout of 16 inches o/c. The chute housing 16 may have a length of about 1-3 feet, a width of about 1-2 feet and a height of about 10 to 20 inches. In some embodiments, the chute housing 16 may have a length of about 2 feet, a width of about 14 inches and a height of about 14 inches. The chute housing 16 may be made of a material having a thickness of between ¼ inch and 1 inch, such as about ½ inch. The chute drawer 14 may be made from a material having a thickness of about ¼ inch to 1 inch, such as about ½ inch. The panel material of the chute pan 12 may have a thickness of about ¼ inch to 1 inch. The sheet metal of the chute pan 12 may have a thickness of between about 0.022 inch to 0.024 inch. The drawer slides 26 are sized to accommodate the size of the chute housing 16 and the chute drawer 14 to enable the chute drawer to slide forwards and backwards thereon. In some embodiments, the drawer slides may have a length of about 12 to 24 inches and a height of about 2 to 4 inches.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A mechanical chute apparatus for waste removal, the mechanical chute apparatus comprising:

a chute housing configured for installation in a chute apparatus opening in a wall of a building structure, the chute housing having a housing top, a housing bottom, a first housing side, a second housing side and a housing interior surface;

a housing curved pivot located at the housing bottom on the housing interior surface;

a chute drawer removably installed in the chute housing and slidably engaged with the chute housing, the chute drawer having a first drawer side, a second drawer side, a drawer rear and a drawer front defining a central drawer opening;

a chute pan pivotally mounted to the chute drawer at a rear lower portion of the drawer front, the chute pan having a front chute pan end, a rear chute pan end and a chute pan opening, the chute pan further having a first horizontal position wherein the rear chute pan end is horizontal to the front chute pan end and at least a portion of the chute pan opening is adjacent to a lower surface of the chute drawer, and a second pivoted position supported by the housing curved pivot wherein the rear chute pan is positioned at an angle to and below the drawer front; and drawer hardware configured to mount the chute drawer in the chute housing and to open and close the chute drawer;

wherein when the chute drawer is opened by an operator of the mechanical chute apparatus, the chute pan is in its first horizontal position to enable the operator to place at least one waste item in the chute pan, and in response to the chute drawer being closed by the operator, the chute pan is placed in its second pivoted position to permit the at least one waste item to fall out of the chute pan for disposal thereof.

2. The mechanical chute apparatus of claim 1, further comprising a drawer exterior face fixed to the drawer front.

3. The mechanical chute apparatus of claim 2, wherein the drawer face is adhesively mounted to the drawer front.

4. The mechanical chute apparatus of claim 2, wherein the drawer face is mechanically fastened to the drawer front.

5. The mechanical chute apparatus of claim 2, wherein the drawer hardware configured to open and close the chute drawer comprises a drawer pull mounted to the drawer exterior face.

6. The mechanical chute apparatus of claim 1, wherein the drawer hardware configured to mount the chute drawer comprises a first drawer slide mounted to the first housing side and a second drawer slide mounted to the second housing side.

7. The mechanical chute apparatus of claim 1, wherein the chute pan is pivotally mounted to the chute drawer by a chute hinge.

8. The mechanical chute apparatus of claim 7, wherein at least a portion of the chute housing and at least a portion of the chute drawer are made of marine grade high density polyethylene (HDPE) panels.

9. The mechanical chute apparatus of claim 1, further comprising at least one chute ventilation opening provided in the housing.

10. The mechanical chute apparatus of claim 9, wherein the at least one chute ventilation opening is located at the housing top.

11. The mechanical chute apparatus of claim 1, wherein the chute housing and the chute drawer are made of a material comprising plastic.

12. The mechanical chute apparatus of claim 1, wherein at least a portion of the mechanical chute apparatus is made of a material selected from the group consisting of plastic, fiber-reinforced plastic, sheet metal, and plywood.

* * * * *